US009688462B2

(12) United States Patent
Rivera et al.

(10) Patent No.: US 9,688,462 B2
(45) Date of Patent: Jun. 27, 2017

(54) EGG STACKING DEVICE

(71) Applicants: Lizbeth Rivera, Ridgefield, NJ (US); Maritza Gonzalez, Ridgefield, NJ (US)

(72) Inventors: Lizbeth Rivera, Ridgefield, NJ (US); Maritza Gonzalez, Ridgefield, NJ (US)

( * ) Notice: Subject to any disclaimer, the term of this patent is extended or adjusted under 35 U.S.C. 154(b) by 0 days.

(21) Appl. No.: 14/517,902

(22) Filed: Oct. 19, 2014

(65) Prior Publication Data

US 2016/0107827 A1 Apr. 21, 2016

(51) Int. Cl.

| | |
|---|---|
| ***B65D 85/32*** | (2006.01) |
| ***A47B 87/02*** | (2006.01) |
| ***A47G 19/28*** | (2006.01) |
| ***B65D 21/02*** | (2006.01) |
| ***F25D 25/00*** | (2006.01) |

(52) U.S. Cl.

CPC ..... *B65D 85/32* (2013.01); *A47B 87/0253* (2013.01); *A47G 19/28* (2013.01); *B65D 21/0204* (2013.01); *B65D 21/0215* (2013.01); *F25D 25/00* (2013.01); *F25D 2331/807* (2013.01); *F25D 2331/809* (2013.01)

(58) Field of Classification Search

CPC ..... A47G 19/28; A47G 19/30; A47B 87/02; A47B 87/0207; A47B 87/0253; A47B 87/0261; A47B 87/0276; B65D 85/32; B65D 21/0215; B65D 21/0204; F25D 25/00; F25D 2331/809; F25D 2331/807; A23B 5/04

USPC ..... 211/85.4, 14, 188, 194

See application file for complete search history.

(56) References Cited

U.S. PATENT DOCUMENTS

| | | | | |
|---|---|---|---|---|
| 1,540,792 | A * | 6/1925 | McLaren | 211/85.4 |
| 1,686,515 | A * | 10/1928 | Chandler | 312/108 |
| 1,759,398 | A * | 5/1930 | Hart | A47G 19/28 119/322 |
| 2,912,335 | A * | 11/1959 | Haller | A23B 5/015 426/238 |
| 3,999,818 | A * | 12/1976 | Schankler | 312/111 |
| 4,192,562 | A * | 3/1980 | Bishoff et al. | 312/108 |
| 5,065,923 | A * | 11/1991 | Hoefer | A47G 19/30 141/320 |
| 5,285,907 | A * | 2/1994 | Franchere et al. | 211/74 |
| 5,666,713 | A * | 9/1997 | Kubota | 29/525.01 |
| 7,334,529 | B1 * | 2/2008 | Liao | B65D 19/0018 108/57.26 |
| 8,157,090 | B2 * | 4/2012 | Ingvardsen et al. | 206/315.9 |
| 8,176,857 | B2 * | 5/2012 | Ochs | A47B 87/002 108/23 |

(Continued)

*Primary Examiner* — Daniel J Troy
*Assistant Examiner* — Hiwot Tefera
(74) *Attorney, Agent, or Firm* — Dunlap Bennett & Ludwig PLLC

(57) ABSTRACT

An egg holder is provided. The egg holder has a top portion including an upper surface and a lower surface. The upper surface may include a first vertical connector. The egg holder may further include at least one sidewall protruding from the lower surface of the top portion. The sidewall may include a second vertical connector. The second vertical connector may mate and releasably connect with the first vertical connector of a different egg holder. The present invention further includes a cup extending downward and formed to secure an egg within. A plurality of egg holders may be stacked vertically relative to one another using the first and second vertical connectors.

3 Claims, 3 Drawing Sheets

(56) References Cited

U.S. PATENT DOCUMENTS

| | | | | |
|---|---|---|---|---|
| 8,579,389 | B1 * | 11/2013 | Kuo | 312/111 |
| 8,601,765 | B2 * | 12/2013 | Lord | 52/582.2 |
| 2003/0010777 | A1 * | 1/2003 | Milgrom B65D | 21/0215 219/725 |
| 2004/0040923 | A1 * | 3/2004 | Wolff | 211/194 |
| 2011/0241505 | A1 * | 10/2011 | Tashjian | 312/198 |
| 2012/0018429 | A1 * | 1/2012 | Claffy B65D | 21/0223 220/200 |
| 2012/0229006 | A1 * | 9/2012 | Zalewski | 312/107 |
| 2014/0137575 | A1 * | 5/2014 | Guerrero | 62/64 |

* cited by examiner

EGG STACKING DEVICE

BACKGROUND OF THE INVENTION

The present invention relates to storing eggs and, more particularly, to an egg holder and stacking device.

An egg carton is a carton designed for carrying and transporting whole eggs. These cartons have a dimpled form in which each dimple accommodates an individual egg and isolates that egg from eggs in adjacent dimples. This structure helps protect eggs against stresses exerted during transportation and storage by absorbing a lot of shock and limiting the incidents of fracture to the fragile egg sheds. Egg cartons tend to take up a at of space within a refrigerator. Regardless of whether the carton has a dozen eggs or one egg within, the carton remains the same size and thereby continues to take up space within the refrigerator.

As can be seen, there is a need for a device that allows for egg storage in different configurations that allow for a more efficient use of refrigerator space.

SUMMARY OF THE INVENTION

In one aspect of the present invention, an egg holder comprises: a top portion comprising an upper surface and a lower surface, wherein the upper surface comprises a first vertical connector; at least one sidewall protruding from the lower surface, wherein the at least one sidewall comprises a second vertical connector configured to mate and releasably connect with the first vertical connector of a second egg holder; and a cup formed to secure an egg within, wherein the cup extends downwards from the top portion and is disposed in between the at least one sidewall.

In another aspect of the present invention, an egg holder comprises: a top portion comprising an upper surface and a lower surface; at least one sidewall protruding from the lower surface; a plurality of sides formed by the top portion and the at least one sidewall, wherein at least a first side of the plurality of sides comprises a first horizontal connector, and at least a second side of the plurality of sides comprises a second horizontal connector configured to mate and releasably connect with the first horizontal connector of a second egg holder; and a cup formed to secure an egg within, wherein the cup extends downwards from the top portion and is disposed in between the at least one sidewall.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a plurality of egg holders that stack and connects single eggs in a horizontal or vertical position. By stacking and connecting single egg holders, a user may efficiently use space within a refrigerator. The present invention may be used horizontally and vertically to store more than one egg in areas that are limited in space in the refrigerator. Once one egg is removed, the single egg holder may be disconnected, cleaned and stored away until more eggs are purchased for storage.

Figure 1:
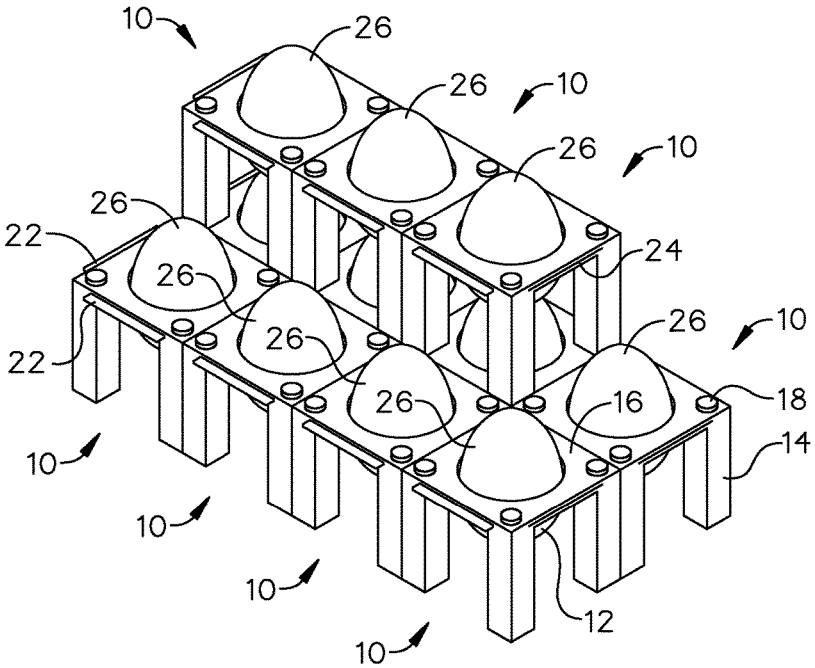
FIG. 1 is a perspective view of the present invention, shown in use.
Figure 2:
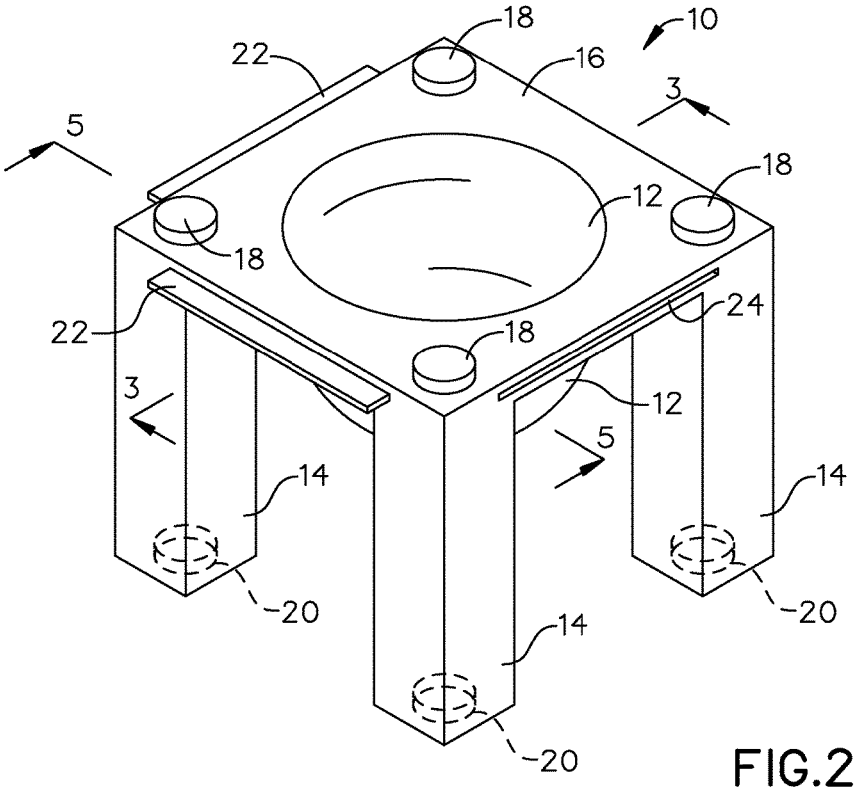
FIG. 2 is a perspective view a single unit of the present invention.
Figure 3:
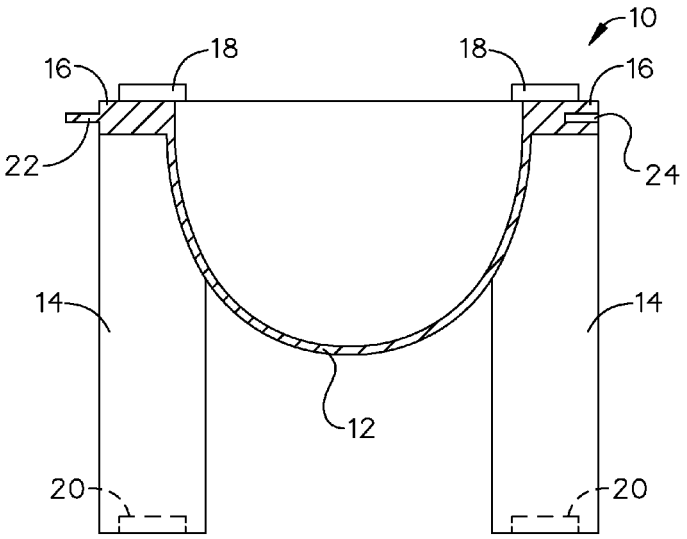
FIG. 3 is a section view of the present invention, taken along line 3-3 in FIG. 2.
Figure 4:
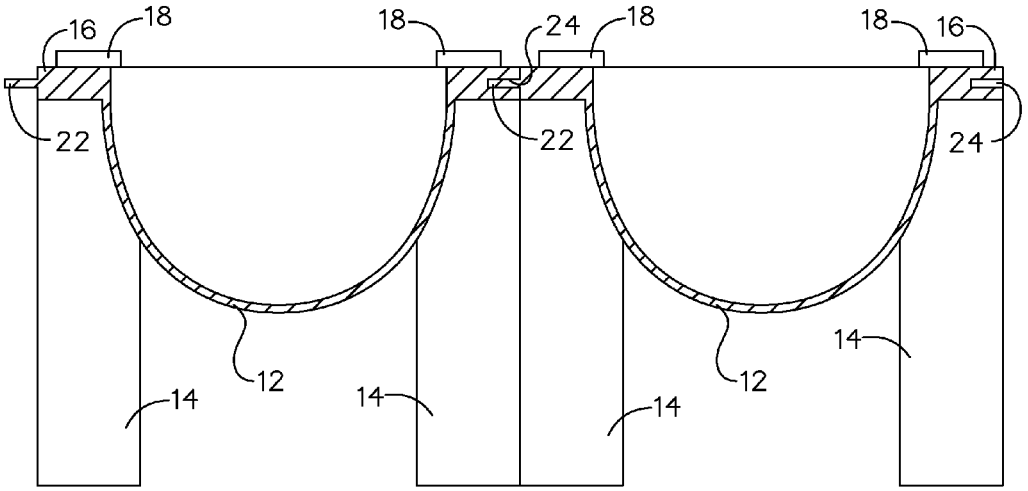
FIG. 4 is a section view of the present invention, illustrating the horizontal connection of two units.
Figure 5:
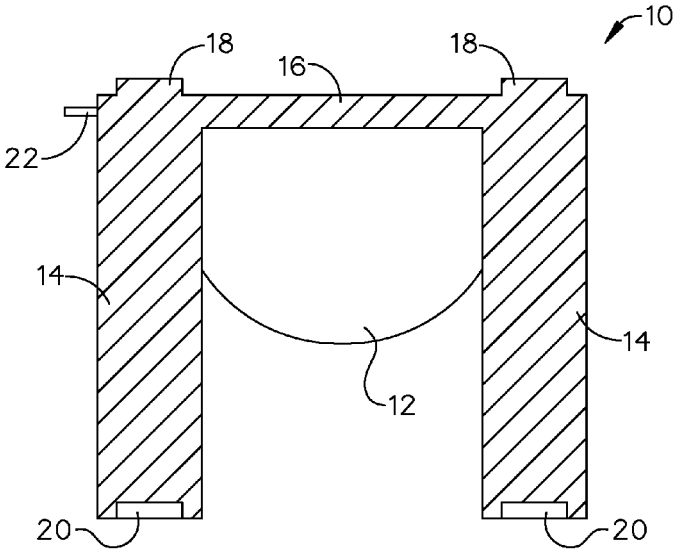
FIG. 5 is a section view of the present invention, taken along line 4-4 in FIG. 2.
Figure 6:
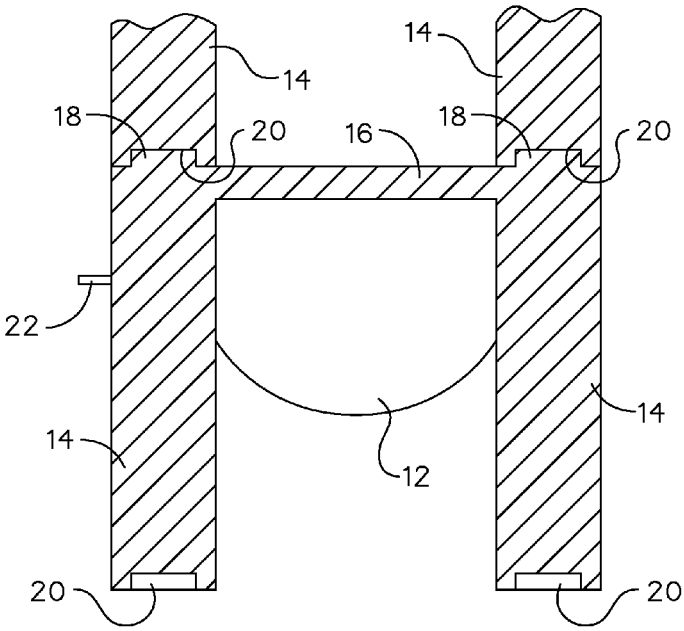
FIG. 6 is a section view of the present invention, illustrating the vertical connection of two units.

Referring to FIGS. 1 through 6, the present invention includes an egg holder 10. The egg holder 10 has a top portion 16 including an upper surface and a lower surface. The upper surface may include a first vertical connector 18. The egg holder 10 may further include at least one sidewall 14 protruding from the lower surface of the top portion 16. The sidewall 14 may include a second vertical connector 20. The second vertical connector 20 may mate and releasably connect with the first vertical connector 18 of a different egg holder 10. The present invention further includes a cup 12 extending downward and formed to secure an egg 26 within. A plurality of egg holders 10 may be stacked vertically relative to one another using the first and second vertical connectors 18, 20.

The sidewall 14 of the present invention may be formed by a plurality of legs. In certain embodiments, the plurality of legs may include four legs. Each of the legs may include the second vertical connector 20. In such embodiments, the upper surface may include four first vertical connectors 18 that align with, and thereby connect with the four second vertical connectors 20 of a different egg holder 10.

In certain embodiments, a plurality of sides may be formed by the top portion and the plurality of legs. At least a first side of the plurality of sides includes a first horizontal connector 22, and at least a second side of the plurality of sides includes a second horizontal connector 24 configured to mate and releasably connect with the first horizontal connector 22 of a different egg holder 10. The plurality of sides may include four sides. The first side and a fourth side of the four sides may each include the first horizontal connector 22, and the second side and a third side of the four sides may each include the second horizontal connector 24. Therefore, the first and second horizontal connectors 22, 24 of different egg holders 10 may connect and releasably secure the two egg holders 10 together in a horizontal fashion.

In certain embodiments, the first vertical connector 18 may include a vertical tab protruding from the upper surface of the top portion 16. Therefore, four vertical tabs may protrude from the upper surface. The plurality of legs may each include a vertical slot. The vertical slot may be formed by a recess within the bottoms of each of the plurality of legs. The vertical slots and the vertical tabs mate with one another and releasably connect the two egg holders 10 together in a vertical fashion.

In certain embodiments, the first horizontal connector 22 may include a horizontal tab protruding from the first and fourth side of the four sides. For example, the horizontal tab may protrude from either the legs or the top portion 16. The second and third sides may each include a horizontal slot. The horizontal slot may be formed by a recess within the either the sides of the legs of the top portion 16. The horizontal slots and the horizontal tabs mate with one another and releasably connect the two egg holders 10 together in a horizontal fashion.

It should be understood, of course, that the foregoing relates to exemplary embodiments of the invention and that modifications may be made without departing from the spirit and scope of the invention as set forth in the following claims.

What is claimed is:

1. An egg holder comprising:

a top portion comprising an upper surface and a lower surface, wherein the upper surface comprises a first vertical connector;

a plurality of legs protruding from the lower surface and disposed vertically, wherein a bottom of the plurality of legs comprises a second vertical connector configured to mate and releasably connect with the first vertical connector of another egg holder;

a plurality of sides formed by the plurality of legs, wherein a first side comprises a first elongated tab protruding therefrom and a fourth side comprises a second elongated tab protruding therefrom, wherein each of the first elongated tab and the second elongated tab are disposed horizontally and comprise a rectangular shape having a flat top surface and a flat bottom surface wherein a second side comprises a first elongated slot disposed horizontally and a third side comprises a second elongated slot disposed horizontally, wherein the elongated tabs are configured to horizontally insert into the elongated slots of other egg holders; and an egg cup comprising an ovoid shape formed on the top portion and sized to secure an egg within, wherein the cup extends downwards from the top portion and is disposed in between the plurality of legs, wherein the plurality of legs comprises a perimeter sized to border no more than one egg cup in between.

2. The egg holder of claim 1, wherein the plurality of legs comprises four legs each comprising the second vertical connector wherein the upper surface comprises four first vertical connectors.

3. The egg holder of claim 1, wherein the first vertical connector comprises a vertical tab and the second vertical connector comprises a vertical slot.

* * * * *